United States Patent [19]

Wood, Jr. et al.

[11] 4,452,498

[45] Jun. 5, 1984

[54] CABINET DRAWER INTERLOCK

[75] Inventors: Ronald L. Wood, Jr.; Robert J. Tempas, both of Bensenville, Ill.

[73] Assignee: B & W Corporation, Bensenville, Ill.

[21] Appl. No.: 366,226

[22] Filed: Apr. 7, 1982

[51] Int. Cl.[3] ..... E05C 15/04

[52] U.S. Cl. ..... 312/216; 312/217; 312/220; 312/221; 312/107.5

[58] Field of Search ..... 312/215, 216, 217, 218, 312/219, 220, 221, 107.5, 276

[56] References Cited

U.S. PATENT DOCUMENTS

| | | | |
|---|---|---|---|
| 1,716,274 | 6/1929 | Jones | 312/217 |
| 2,835,547 | 5/1958 | Erismann | 312/219 |
| 3,454,320 | 7/1969 | Olree | 312/217 |
| 3,560,068 | 2/1971 | Ostrom | 312/217 |
| 3,881,793 | 5/1975 | Anderson | 312/217 |
| 3,936,108 | 2/1976 | Chitester | 312/217 |

FOREIGN PATENT DOCUMENTS

| | | | |
|---|---|---|---|
| 2315109 | 10/1974 | Fed. Rep. of Germany | 312/216 |
| 2446620 | 9/1980 | France | 312/216 |

*Primary Examiner*—Victor N. Sakran

*Attorney, Agent, or Firm*—Robert E. Wagner; Alan L. Barry

[57] ABSTRACT

A locking device for interlocking drawers in a file cabinet includes an elongated L-shaped locking member pivoted adjacent to an interior corner of the cabinet and cooperating with a fixed arm on each of the cabinet drawers so that withdrawal of any drawer pivots the L-shaped member to prevent the withdrawal of any other drawer.

1 Claim, 5 Drawing Figures

CABINET DRAWER INTERLOCK

DESCRIPTION

1. Technical Field

The present invention generally relates to filing cabinets having a plurality of vertically stacked drawers and, more particularly, to a device for interlocking cabinet drawers so that when one drawer has been withdrawn from the cabinet, other drawers are locked within the cabinet and are thereby prevented from being withdrawn.

2. Background of the Invention

A problem often encountered with vertical filing cabinets occurs when more than one drawer is withdrawn from a cabinet. When several drawers are withdrawn, the entire cabinet may become out of balance because of the uneven weight distribution created by a loaded drawer jutting out of the cabinet. Because of this imbalance, it is possible that the entire cabinet will overturn with possible injury to persons or property in the surrounding area.

Many devices are known in the art which interlock all drawers within a cabinet whenever a single drawer is withdrawn from the cabinet. Hence, only one drawer may be withdrawn from a cabinet at a time eliminating the imbalance. Several known interlock devices include vertically slidable elongated members which abut against a portion of a drawer structure to prevent withdrawal of the drawer. Other interlock devices, such as U.S. Pat. Nos. 3,454,320 and 3,881,793 are comprised of a vertically mounted rod having respective cams for each drawer which are engaged and rotated into a locked position by raised shoulders or flanges mounted to each drawer. However, these interlocks heavily depend on the continued structural integrity of the cam to properly function and it is well known that the peripheral edges of a cam are easily worn by continued use.

Moreover, it is common for persons utilizing cabinets fitted with interlocks to forget that only one drawer may be withdrawn from the cabinet at a time. As a result, an attempt is made to withdraw another drawer causing the locked drawer to strike the interlock with considerable force. The accidental forcing of a locked drawer against the interlock accelerates wear with possible damage to less durable interlocks. Thus, a need exists for a cabinet drawer interlock comprised of the fewest parts and yet durable enough to withstand the wear and tear these devices are subject to. Additional benefits of a more simplified cabinet drawer interlock would be ease of installation and lower manufacturing costs.

SUMMARY OF THE INVENTION

According to the present invention, a simplified cabinet drawer interlock has been developed utilizing fewer parts yet comprising an extremely reliable and durable device.

Specifically, the cabinet drawer interlock of the present invention is comprised of an elongated L-shaped locking member which is vertically and pivotally mounted in close proximity to an interior corner (preferably a rear interior corner) of a filing cabinet. When all drawers are closed within the cabinet, the locking member rests in an unlocked position. In this position, one leg of the L-shape is directed toward the rear wall of the cabinet and the other leg is directed to the cabinet side wall opposing the side wall that comprises the interior cabinet corner near which the locking member is mounted. The present invention further includes an L-shaped bracket having one leg free and another leg fixed to each drawer at the exterior drawer corner coinciding to the interior cabinet corner. The free leg of the bracket points to the same cabinet side wall comprising the interior corner and is parallely juxtaposed to the leg of the L-shaped locking member that points to the opposing cabinet side wall. When a drawer is withdrawn from the cabinet, the free leg of the drawer bracket contacts the parallel leg of the L-shaped locking member causing the member to rotate 90° in one direction to a locked position. In the locked position, the leg of the locking member once pointing to the rear cabinet wall now points to the opposing cabinet side wall thereby presenting a flat blocking surface to the drawer brackets of the remaining drawers to prevent and impede the withdrawal of another drawer from the cabinet.

DETAILED DESCRIPTION

Figure 1:
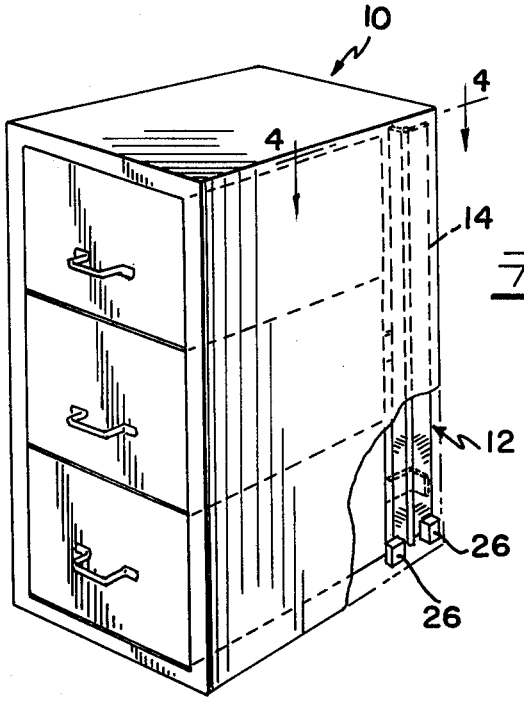
FIG. 1 is a fragmentary perspective view of a standard vertical filing cabinet fitted with the cabinet drawer interlock of the present invention.

Referring in more detail to the drawings, FIG. 1 illustrates a standard vertical filing cabinet generally referenced by 10. A lower rear portion of cabinet 10 is cut away to reveal cabinet drawer interlock 12 of the present invention. FIG. 1 further illustrates the preferred placement of cabinet drawer interlock 12 within cabinet 10 such that interlock 12 is positioned in proximity to a selected rear interior corner of cabinet 10. Although it is conceivable that interlock 12 could be positioned in either forward interior corners of cabinet 10, it is believed that interlock 12 functions most efficiently and utilizes the least amount of space within cabinet 10 by positioning interlock 12 in a rear interior corner of a cabinet. FIG. 1 illustrates in phantom the placement of an elongated L-shaped locking member 14 of interlock 12 within cabinet 10. Locking member 14 is vertically and pivotally mounted in close proximity to the selected interior cabinet corner.

Figure 2:
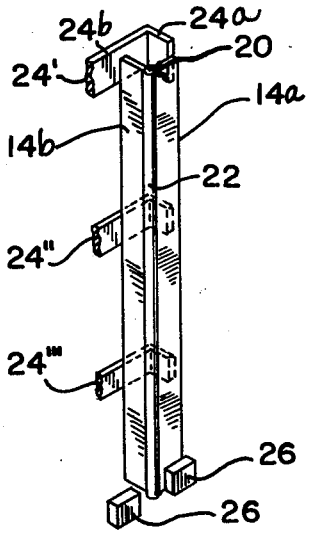
FIG. 2 is a floating perspective view of the elements of the present invention showing the L-shaped locking member in a locked position.

FIG. 2 discloses the essential components of drawer interlock 12. L-shaped locking member 14 is preferably manufactured from a relatively rigid steel in order to insure the reliability and continued functioning of interlock 12. Locking member 14 is comprised of legs **14*a* and 14*b* which are perpendicular to each other to define a right angle between each leg. A pin 20 extends into a columnar shaft 22 which permits the pivotal mounting of interlock 12. FIG. 2 shows locking member 14** in an unlocked position.

FIG. 2 further discloses L-shaped drawer brackets 24', 24'' and 24''' which are mounted to each of the drawers of cabinet 10 at the exterior drawer corner coinciding with the selected interior cabinet corner. Drawer brackets 24 include an engaging leg **24*a* which is perpendicular to and forms a right angle with bracket mounting leg 24*b*. It is to be noted that engaging leg 24*a* is parallely juxtaposed to leg 14*b* when locking member 14 rests in an unlocked position. Leg 14*a* and 14*b* abut against blocks 26 depending on whether locking member 14 is in a locked or unlocked position. Since FIG. 2 illustrates member 14 in an unlocked position, leg 14*a* is abutted against block 26. Blocks 26 are provided to limit the pivoting of locking member 14** to a 90° movement.

Figure 3:
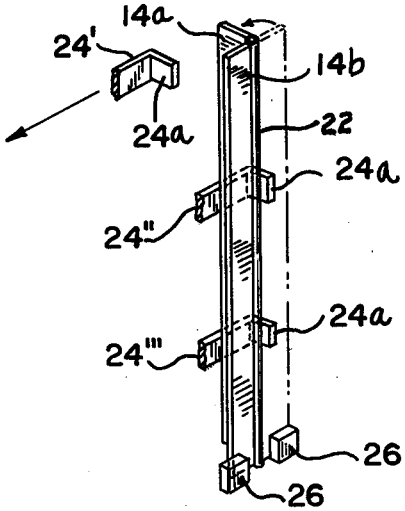
FIG. 3 is a floating perspective view of the elements of the present invention showing the L-shaped locking member in a locked position after contact with an L-shaped drawer bracket.

FIG. 3 illustrates the relative spatial orientation of the components of interlock 12 after drawer bracket 24' (corresponding to the top drawer of cabinet 10) has been withdrawn from cabinet 10 placing member 14 in a locked position. Engaging legs **24*a* of drawer bracket 24'' and 24''' have now become parallely juxtaposted to leg 14*a* after locking member 14 has pivoted 90° in the direction indicated by arrow from an unlocked position (shown in phantom) to a locked position. Leg 14*a* of member 14 provides a flat impediment to the withdrawal of additional drawers from cabinet 10. That is, legs 24*a* of drawer brackets 24'' and 24''' would strike against and be restrained by leg 14*a* if a person attempted to withdraw either of the drawers corresponding to these drawer brackets. The locking mode of the present invention represents a more reliable method of interlocking cabinet drawers. By relying on contact of the flat surface of bracket leg 24*a* against the parallely flat surface of locking member leg 14*a***, the present invention is clearly more durable than prior art interlocks which utilizes cams or springs.

Figure 4:
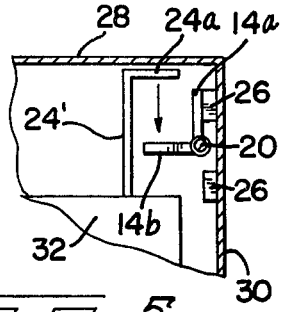
FIG. 4 is an enlarged fragmentary cross-sectional plan view taken through line 4—4 of FIG. 1 showing the cabinet drawer interlock of the present invention resting in an unlocked position.

FIG. 4 illustrates the operation of drawer interlock 12. The pivotal mounting of locking member 14 in close proximity to the selected interior corner of cabinet 10 is such that member 14 has sufficient clearance to pivot 90° in either direction. FIG. 4 discloses locking member 14 in an unlocked position in which leg **14*a* rests against block 26 so that leg 14*a* is pointing to rear cabinet wall 28. In the unlocked position, leg 14*b* is pointing to the cabinet side wall which opposes cabinet side wall 30 to which abutment blocks 26 are mounted. Drawer bracket 24' is mounted to top drawer 32 in such a manner that leg 24*a* is parallely juxtaposed to leg 14*b*. This positioning of leg 24*a* with leg 14*b* permits leg 24*a* to contact and engage leg 14*b* upon withdrawal of top drawer 32 in the direction indicated by the arrow in FIG. 4**.

Figure 5:
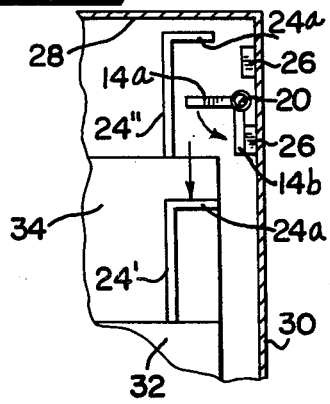
FIG. 5 provides the same view as FIG. 4 but now shows the interlock of the present invention resting in a locked position after the withdrawal of a drawer from the cabinet.

FIGS. 4 and 5 illustrate that as top drawer 32 is withdrawn from cabinet 10, leg **24*a* of drawer bracket 24' contacts leg 14*b* to pivot locking member 14, 90° in the direction indicated by the arrow in FIG. 5. The arcuate movement of locking member 14 is arrested by abutment of leg 14*b* against block 26 to bring locking member 14 to a locked position. In such locked position, leg 14*a* becomes parallely juxtaposed to engaging leg 24*a* of drawer bracket 24'' so that the surface of leg 14*a* prevents second drawer 34 from being withdrawn from cabinet 10. Of course, when top drawer 32 is pushed back into cabinet 10, the operation is reversed so that locking member 14 pivots 90° in an opposite direction to cause leg 14*a* to abut against block 26 bringing locking member 14** back to an unlocked position.

FIGS. 4 and 5 further illustrate that when interlock 12 is in an unlocked mode, the right angle formed between legs **14*a* and 14*b* of member 14 is non-coincident with the right angle formed within the selected interior corner. However, when interlock 12 is in a locked mode, the right angle of member 14** becomes coincident with the right angle defined by the selected interior corner.

While this invention is susceptible of embodiment in many different forms, there has been shown in the drawings and described in detail a preferred embodiment of the invention. The present disclosure is considered an exemplification of the principles of the invention and is not intended to limit the broader aspects of the invention to the embodiment illustrated.

We claim:

1. In a device for interlocking drawers in vertically tiered filing cabinets having a pivoting vertical locking member mounted within the cabinet and an L-shaped bracket mounted to each drawer for engaging the locking member, the improvement comprising:

a locking member being dimensionally and geometrically compatible with interior corners of the cabinet, the member being mounted in juxtaposition substantially within a selected interior corner of the cabinet, said member being parallely juxtaposed to the cabinet side wall defining the selected interior corner, said member having two elongated perpendicular legs secured to a columnar hinge shaft at the apex of the right angle defined by said legs, the shaft defining a vertical axis around which the legs arcuately swing within the selected interior corner; and at least two abutment blocks mounted to said cabinet side wall, the blocks being positioned on the cabinet side wall so that each leg abuts against one of the blocks to limit arcuate swing of the legs to 90°, whereby said member is in a locked position when the right angle defined by the legs is geometrically coinciding with the right angle defined by the selected cabinet interior and said member is in an unlocked position when the right angle defined by the legs is geometrically non-coinciding with the right angle defined by the selected cabinet interior corner.

* * * * *